United States Patent [19]

Dippert et al.

[11] Patent Number: 4,829,920

[45] Date of Patent: May 16, 1989

[54] METHOD AND APPARATUS FOR POSITIONING AND HOLDING A THREAD CHAIN

[75] Inventors: Rainer Dippert; Karl Müssig, both of Bad Königshofen, Fed. Rep. of Germany

[73] Assignee: Pfaff Industriemaschinen GmbH, Fed. Rep. of Germany

[21] Appl. No.: 158,405

[22] Filed: Feb. 22, 1988

[30] Foreign Application Priority Data

Feb. 23, 1987 [DE] Fed. Rep. of Germany ..... 3705679

[51] Int. Cl.[4] ..... D05B 65/00

[52] U.S. Cl. ..... 112/288; 112/301; 112/DIG. 1; 112/269.1

[58] Field of Search ..... 112/285, 287, 288, 301, 112/DIG. 1, 269.1

[56] References Cited

U.S. PATENT DOCUMENTS 3,159,124 12/1964 Rubin ..... 112/288 X
3,356,054 12/1967 Southwell et al. ..... 112/287
3,698,336 10/1972 Launer ..... 112/287 X
4,644,884 2/1987 Tatsumi ..... 112/288 X

FOREIGN PATENT DOCUMENTS 28210 5/1981 European Pat. Off. ..... 112/287

*Primary Examiner*—Wm. Carter Reynolds
*Attorney, Agent, or Firm*—McGlew & Tuttle

[57] ABSTRACT

Apparatus and method of positioning and holding a thread chain for sewing onto successively fed workpieces, a thread chain which had been sewn beyond the rear edge of a workpiece and had been cut off flush with the rear edge of the workpiece, is sucked into the suction aperture of a suction tube. The suction tube is movable in a path parallel to the stitch plate of the sewing machine first in a catch position behind the needle and then the tube is moved into a delivery position before the needle aligned with a seam line (N). The chain is clamped there under a tensile stress in such a way that complete inclusion of the thread chain into the next following seam is possible. The suction tube extends parallel to the stitch plate and has a suction aperture into which the severed thread chain is sucked. The tube is moved to a delivery position in which the thread chain is pressed against an elastic abutment. The suction aperture of the suction tube and the abutment form a clamp for the thread chain and the thread chain is pulled out of the clamp with a continued feed of the workpiece.

5 Claims, 1 Drawing Sheet

Fig. 1
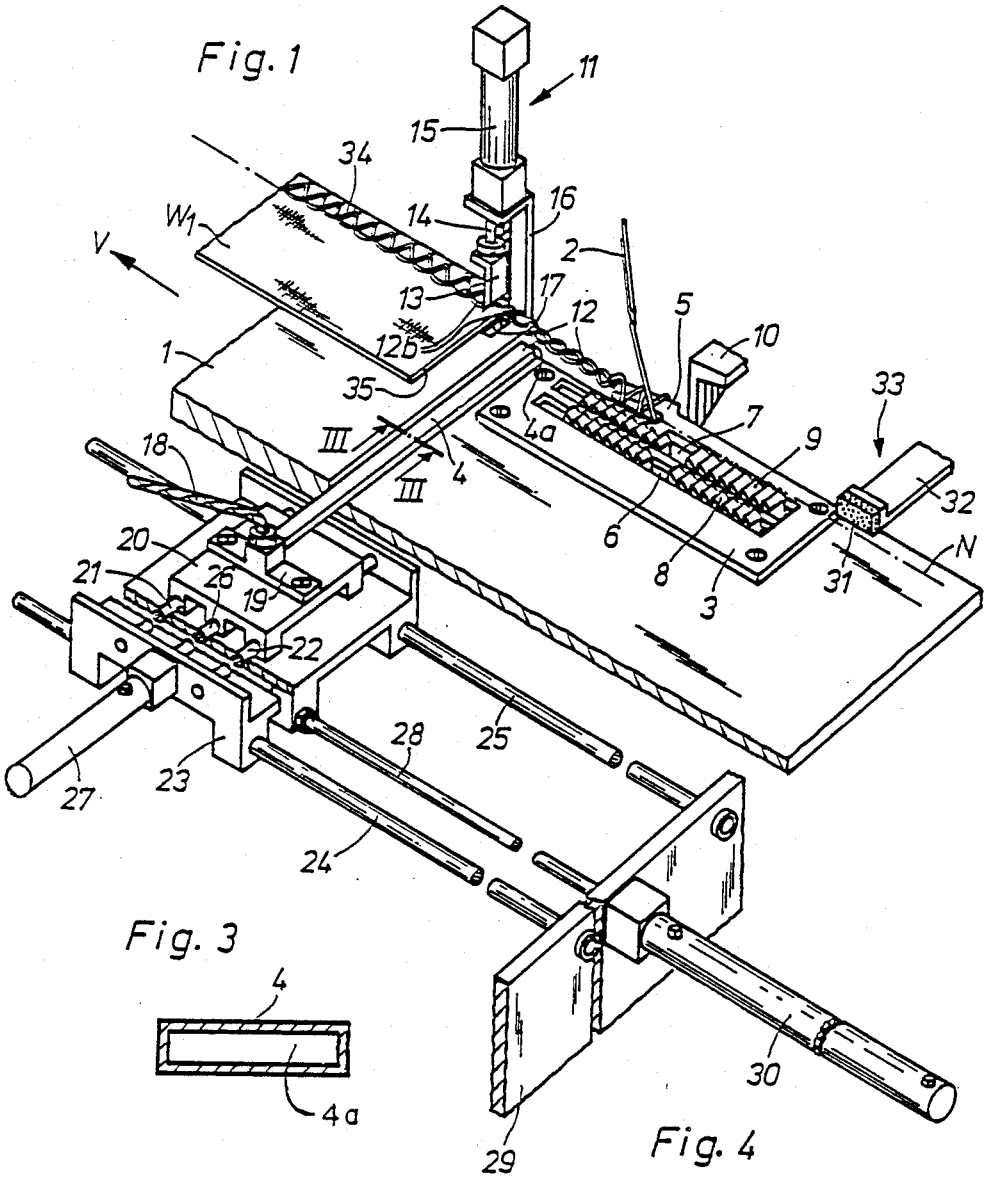
Fig. 3
Fig. 2
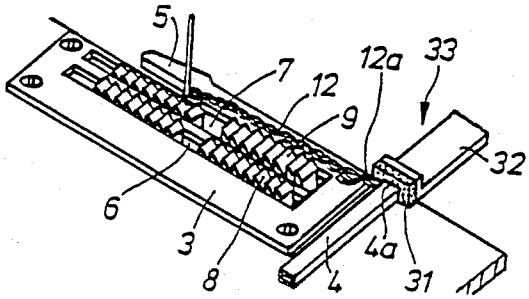
Fig. 4
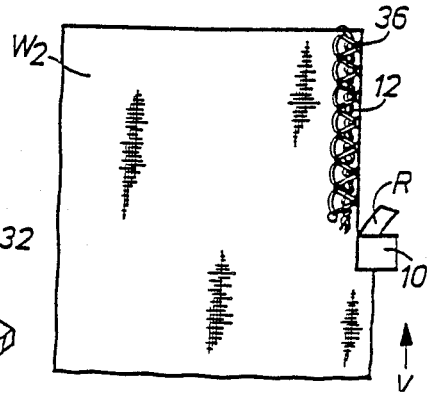

METHOD AND APPARATUS FOR POSITIONING AND HOLDING A THREAD CHAIN

BACKGROUND OF THE INVENTION

Field of the Invention

This invention relates, in general, to sewing devices and, in particular, to a new and useful apparatus and method for positioning and holding a thread chain for sewing it onto successively fed workpieces.

The known apparatus (U.S. Pat. No. 3,356,054) comprises an L-shaped suction tube which is arranged above the sewing machine for rotation about the mount of a suction line and communicates with the suction line and which has a suction aperture in the region of the lower end. The suction tube is rotatable between a catch position behind the needle and delivery position in front of the needle, so as to suck up the free thread chain formed behind the sewn workpiece and severed from the workpiece and to move it in a rotary movement into the delivery position in front of the needle and to hold it there so that the thread chain is bound into the seam to be formed at the next workpiece.

In this known apparatus, the suction tube describes an arc of a relatively large radius and therefore is usable only where the space to the left of the needle above the stitch plate is free. This space can therefore not be utilized for the arrangement of attachments.

When being bound into the new seam, the thread chain must be held under a certain tensile stress. However, with suction air alone a sufficiently great holding force is not attainable.

From U.S. Pat. No. 4,149,478 an overcast sewing machine is known, on which in spaced relation workpieces are fed in a transport direction and sewn, the thread chain being continued to be sewn a distance beyond the terminal edge of the first workpiece. Laterally of the seam line, a suction tube with a cutter for the thread chain is arranged after the needle. The thread chain is sucked into the suction tube and severed next to the end edge of the workpiece. Before the cutter, a blow nozzle is provided. The part of the thread chain which, having been cut by the blade, leads to the needle and is blown by the air stream issuing from the nozzle, counter to the transport direction. It is blown in front of the needle under a lifted clamping arm and is sucked into a suction tube disposed next to the clamping arm. Then the thread chain is pressed by the clamping arm against the cloth bearing surface. As the next following workpiece which is guided over the clamping arm is being supplied and sewn, the thread chain to be bound into the new seam is pulled out from under the clamping arm and sewn into the new seam.

The arrangement has the disadvantage that, at the end of the workpiece sewn first, a thread chain piece protrudes over the rear edge and must be removed by hand. In addition, due to the ejection of air in the direction of the seam line, a controlled introduction of the thread chain to be sewn into the following workpiece under the clamping arm is not always measured even with the aid of the suction, so that the thread chain is not properly aligned. The chain remains unclamped, and is not held taut, so that thread chain remainders may hang from the newly formed seam. As the use of an apparatus for positioning and holding a thread chain is automated, sewing systems presupposes faultless operation of the apparatus, this known apparatus is not suitable for automated sewing systems.

SUMMARY OF THE INVENTION

The invention embodies an apparatus by which it is possible to move the free thread chain out of the catch position to the delivery position so that the region to the left of the needle above the stitch plate is available for the arrangement of accessory units, e.g. a work conveying device. The thread chain is guided to a clamp in a controlled manner and it is securely clamped, and is held aligned with the seam line under a certain tensile strength.

The apparatus according to the invention has the advantage that the space to the left of the needle remains free for example from the arrangement of conveyor belts which grip the work from above and below and thus prevent relative displacement of the fabric plies. Besides, the thread chain is securely gripped and is guided in a controlled manner to the clamp disposed in spaced relation in front of the needle aligned with the seam line and is held in the clamp with a certain tensile stress aligned with the seam line.

Accordingly, it is an object of the invention to provide a method of controlling a thread chain in a sewing machine which is effective to present the chain over a piece of material which is fed to a sewing machine needle and thereafter the needle forms a seam which connects the chain to the material and then the chain is severed, which comprises arranging a suction tube on a carrier so that the tube is at a substantially right angle to the chain, applying suction to the tube and positioning the carrier with the suction tube so that an open suction end of the tube becomes engaged with the cut-away end of the chain by suction engagement and thereafter moving the carrier to position the suction tube with the chain held by the suction tube against an abutment to clamp the chain in a position in which it may be fed to the needle with the next piece of material.

A further object of the invention is to provide an apparatus for positioning a thread chain freed end which is severed from a preceding length which has been sewn on a sewing machine which has a thread needle which reciprocates over a workpiece to form a seam which sews the thread chain to the workpiece material, which comprises a suction tube having an open thread chain engaging end with flexible means connecting the tube to a suction source adjacent its opposite end and which includes a support supporting the tube so that it is substantially perpendicular to the chain with its open end facing the chain adjacent the freed end of the chain and which includes a drive for the support for selectively moving the suction tube thread chain engaging end to engage the thread chain and to move it into a position in which it is clamped against an abutment in which location it may be secured to the next advanced piece of material.

A further object of the invention is to provide an apparatus for positioning and holding a thread chain for inclusion in a next seam to be formed on a sewing machine which is simple in design, rugged in construction and economical to manufacture.

The various features of novelty which characterize the invention are pointed out with particularity in the claims annexed to and forming a part of this disclosure. For a better understanding of the invention, its operating advantages and specific objects obtained by its uses, reference is made to the accompanying drawings and descriptive matter in which preferred embodiments of the invention are illustrated.

BRIEF DESCRIPTION OF THE DRAWINGS

In the Drawings:

FIG. 1 is a front top perspective view of the stitch forming region of an overcast sewing machine with the apparatus for positioning and holding a thread chain with the suction tube and constructed in accordance with the invention shown in a thread chain catch position;

FIG. 2 is a partial view of the sewing machine illustrated in FIG. 1 with the suction tube in the thread chain delivery position;

FIG. 3 is a section through the suction tube taken along the line III—III of FIG. 1, and on a larger scale; and FIG. 4 is a top plan view of a workpiece to be supplied as subsequent workpiece, with the thread chain sewn into the new seam.

GENERAL DESCRIPTION OF THE PREFERRED EMBODIMENTS

Referring to the drawings, in particular, the invention embodied therein comprises an apparatus and method for positioning a thread chain 12 which has a freed end 12*a* which is formed after the chain is severed from a preceding length 12*b* which has been sewed to a first workpiece or material W1. The apparatus includes the suction tube 4 which has an open thread chain engaging end 4*a*. Flexible means such as a suction hose 18 connects the tube 4 to a suction source. Support means in the form of a bracket or support 19 supports the tube 4 at its end opposite to the suction opening. The support is carried on a slideway or a carrier 20. The tube 4 is supported so that it is substantially perpendicular to the thread chain 12 and the seam line N. The open end 4*a* of the tube faces the chain 12 adjacent the free end 12*a* and suction is applied to the tube so as to engage it with the thread chain 12.

Drive means in the form of hydraulic or pneumatic cylinders 27 and 30 are connected to the slideway 20 for selectively moving it with the tube 4 to engage the chain 12 and to hold it or to position it for further sewing to the next fed workpiece. In the embodiment shown, in FIG. 2, the chain 12 is held at its rear end by a clamp formed by the suction tube 4 and an elastic abutment 33 at a position in which the needle 2 is opposite the freed end 12*a*.

The fabric W1 to be sewn is moved over a supporting or carrying plate 1 shown in FIG. 1 of the overcast sewing machine. The machine includes a sewing needle 2 which cooperates for seam formation with a thread-guiding overcast looper (not shown). The supporting plate 1 is offset in the region around the stitch plate 3 approximately by the height of a suction tube 4 of rectangular cross-section, which tube is movable in this offset region. The stitch plate 3 has a stitch-forming tongue 5 and cutouts 6, 7 for passage of the toothed webs 8, 9—which together with upper and lower conveyor belts bring about the work transport—of the cloth feed dog which executes a rectangular motion. The workpiece to be sewn (W1, W2) is pressed against the toothed webs 8, 9 of the cloth feed dog by a raisable presser foot not shown. Laterally and in front of the needle 2, there is a trimming knife 10 for trimming the edge R, FIG. 4 of the workpiece W1, W2.

Spaced behind the needle, there is a cutting device marked 11 for severing the thread chain 12 flush with the edge. The cutter 13 is exchangeably fastened to the piston rod 14 of a pneumatic cylinder 15, which may be adapted to be controlled for example by a light barrier not shown, which senses the rear edge of the workpiece W1, W2. The pneumatic cylinder 15 is fastened to a bracket 16 secured on the housing. During cutting, the cutter 13 slides into a slot 17 in the cloth supporting plate 1.

The suction tube 4 communicates via a suction line 18 with a vacuum source. It is fastened to a support 19 which is screwed to a slideway or carriage 20. The slideway 20 slides on two guiding rods 21, 22 which are fastened to an additional slideway 23. Slideway 23 is displaceable on two guiding rods 24, 25 arranged fixed perpendicular to the guiding rods 21, 22. Due to this arrangement, the suction tube is movable in two directions perpendicular to each other.

The slideway 20 with the suction tube 4 is actuated by the piston rod 26 of a pneumatic cylinder 27 fastened to a slideway or carriage 23, while slideway 23 is actuated by the piston rod 28 of a pneumatic cylinder 30 fastened to a plate 29 of the machine housing.

At a distance before the needle 2, an abutment 33, consisting of an elastic covering 31 on a fixed holder 32, for the edge of the suction opening of the suction tube 4 is arranged. The edge of the suction aperture of the suction tube 4 and the abutment 33 form a clamp for the thread chain 12. The end of the covering 32 is arranged relative to the needle 2 in such a way that the thread chain 12 is completely enclosed in the new seam 36.

Mode of Operation:

As can be seen from FIG. 1, at a longitudinal edge of the first workpiece W1 which is trimmed before the needle 2 by the trimming knife 10 and which is moved in transport direction, arrow V, through the stitch-forming point, an overcast seam 34 is formed. Following the rear edge 35 of the workpiece W1, the thread chain 12 is formed. This thread chain 12 is cut through flush with the edge by the cutter 13. The now free portion of the thread chain 12 is then sucked into the suction opening of the suction tube 4, the thread chain portion lying around the stitch-forming tongue 5 being pulled off the stitch-forming tongue 5.

The suction tube 4, into the suction opening of which the free thread chain 23 had been sucked, is then pulled back by the pneumatic cylinder 27—with the sewing machine stopped in needle-up position and with the presser foot lifted—and by displacement of the slideway 23, it is shifted on the guide rods 24, 25 counter to the transport direction (arrow V) to the level of an abutment 33, whereupon the suction tube 4 with the thread chain 12 sucked into its suction aperture is pressed by the pneumatic cylinder 27 with the edge of the suction aperture against the end face of the elastic covering 31 of the abutment 33, so that the thread chain 12 is clamped between the elastic covering 31, which is aligned with the seam line N, and the edge of the suction aperture of the suction tube 4. In this delivery position of the suction tube 4 the thread chain is now oriented for inclusion in the seam 36 to be formed at the next following workpiece W2, FIG. 4, and is under a certain tensile stress.

When supplying the next following workpiece W2, whose edge R is trimmed by the trimming knife 10 operating in front of the needle 2, the thread chain 12 is sewn into the new seam 36, being pulled out of the clamp formed by the abutment 33 and the edge of the suction aperture of the suction tube 4 as feed continues, so that no thread remainders hang from the workpiece W2. Due to the controlled and hence reliable transfer of the free thread chain 12 into the clamp, the apparatus is especially suitable for use in automated sewing machines.

While specific embodiments of the invention have been shown and described in detail to illustrate the application of the principles of the invention, it will be understood that the invention may be embodied otherwise without departing from such principles.

What is claimed is:

1. A method of controlling a thread chain in a sewing machine which is effective to present the chain over a piece of material which is fed to a sewing machine needle and thereafter the needle forms a seam which connects the chain to the material and the chain is severed, comprising arranging a suction tube on a carrier so that the tube is at substantially right angles to the chain, applying suction to the tube, and positioning the carrier with the suction tube so that an open suction end thereof becomes engaged with the cutaway end of the chain by suction engagement, thereafter moving the carrier to position the suction tube with the chain against an abutment to clamp the chain in a position in which it may be fed to the needle with the piece of material.

2. An apparatus for positioning a thread chain freed end which is severed from a preceding length obtained which has been sewn on a sewing machine which has a thread needle which reciprocates over a workpiece to form a seam which sews the thread chain to the workpiece, and which comprises a suction tube having an open thread chain engaging end, flexible means connecting said tube to a suction source, support means supporting said tube so that it is substantially perpendicular to the seam with its open end facing said chain adjacent the freed end, drive means connected to said support means for selectively moving said suction tube thread chain engaging end between a catch position in which the suction of the tube causes engagement of the thread chain to the open end of said tube and a delivery position in which an abutment is located in the path of movement of said suction tube facing the open end of said tube, said tube being positionable adjacent said abutment in order to clamp the chain therebetween.

3. An apparatus according to claim 2, wherein said abutment includes an elastic surface facing said thread chain which is arranged at a small distance of the seam line.

4. An apparatus for positioning a thread chain freed end which is severed from a preceding length obtained which has been sewn on a sewing machine which has a thread needle which reciprocates over a workpiece to form a seam which sews the thread chain to the workpiece, and which comprises a suction tube having an open thread chain engaging end, flexible means connecting said tube to a suction source, support means supporting said tube so that it is substantially perpendicular to the seam with its open end facing said chain adjacent the freed end, drive means connected to said support means for selectively moving said suction tube thread chain engaging end to engage said thread chain, said suction tube being of rectangular cross section and wherein said sewing machine has a cloth bearing surface with a recess in which said suction tube is movable.

5. An apparatus for positioning a thread chain freed end which is severed from a preceding length obtained which has been sewn on a sewing machine which has a thread needle which reciprocates over a workpiece to form a seam which sews the thread chain to the workpiece, and which comprises a suction tube having an open thread chain engaging end, flexible means connecting said tube to a suction source, support means supporting said tube so that it is substantially perpendicular to the seam with its open end facing said chain adjacent the freed end, drive means connected to said support means for selectively moving said chain, said support means comprising a carrier, guide means for guiding said carrier for transverse and for longitudinal movement.

* * * * *